US007404692B2

(12) United States Patent
Fukumoto et al.

(10) Patent No.: US 7,404,692 B2
(45) Date of Patent: Jul. 29, 2008

(54) BREAKWATER GENERATING STRUCTURE

(75) Inventors: Tadashi Fukumoto, Yamato (JP); Tsuyoshi Hashimoto, Yamato (JP)

(73) Assignee: Nishimatsu Construction Co., Ltd., Tokyo (JP)

( * ) Notice: Subject to any disclaimer, the term of this patent is extended or adjusted under 35 U.S.C. 154(b) by 1038 days.

(21) Appl. No.: 09/863,749

(22) Filed: May 23, 2001

(65) Prior Publication Data

US 2002/0037197 A1 Mar. 28, 2002

(51) Int. Cl.
*E02B 3/06* (2006.01)

(52) U.S. Cl. ..... 405/25; 405/31

(58) Field of Classification Search ..... 405/25, 405/31, 30, 22, 21
See application file for complete search history.

(56) References Cited

U.S. PATENT DOCUMENTS 4,978,247 A * 12/1990 Lenson ..... 405/15

FOREIGN PATENT DOCUMENTS

| | | | | |
|---|---|---|---|---|
| EP | 0 576 771 A1 * | 5/1994 | | |
| JP | 55-110520 | 8/1980 | | |
| JP | 355119812 A * | 9/1980 | ..... | 405/15 |
| JP | 362117905 A * | 5/1987 | ..... | 405/21 |
| JP | 403241111 A * | 10/1991 | ..... | 405/25 |
| JP | 403281811 A * | 12/1991 | ..... | 405/21 |
| JP | 5-132913 | 5/1993 | | |
| JP | 405331817 A * | 12/1993 | ..... | 405/21 |
| JP | 6-7045 | 2/1994 | | |
| JP | 6-46024 | 6/1994 | | |
| JP | 7-57938 | 6/1995 | | |
| JP | 3298862 | 4/2002 | | |

* cited by examiner

*Primary Examiner*—Richard E. Chilcot, Jr.
*Assistant Examiner*—Gay Ann Spahn
(74) *Attorney, Agent, or Firm*—Flynn, Thiel, Boutell & Tanis, P.C.

(57) ABSTRACT

Waves are amplified by a gradual decrease in depth, and when the waves reach a vertical wall 10 of a reef 2, breaking waves are generated by sudden decrease of the water depth. As the breaking waves rush into the upper portion of the reef 2 and pass through the slant slits 14, wave energy is absorbed by the reef 2 and the seat water returns back to the ocean through an opening 11. The sand brought into a reef 2 with the waves are washed away by the return flow 11 so that the sand is not deposited within the reef 2 and the space in the reef 2 is always clear.

The return flow promotes generation of the breaking waves. The breaking waves are introduced into the slits, beach erosion is prevented, and a calm sea area utilized for marine leisure is created. The seawater in the reef, with sufficient air, flows to the sea area behind the breakwater through the paths 19. The sea water containing sufficient oxygen is supplied to the bottom layer behind the breakwater without disturbing the surface so that the oxygen is supplied to the seawater behind the breakwater.

15 Claims, 10 Drawing Sheets

BREAKWATER GENERATING STRUCTURE

FIELD OF THE INVENTION

The present invention relates to coastal erosion control in general and relates specifically to a breakwater generating structure such as a submerged breakwater generating structure of an offshore breakwater generating structure.

PRIOR ART

For beach erosion control or creation of a calm sea water area for marine leisure, various breakwater generating structures using wave breaking have been proposed.

Japanese Patent Laid-Open Hei 4-289310(1992-289610, A,JP) discloses a breakwater generating structure that uses terraced horizontal plates of which the deepest part is placed facing the offshore side. Japanese Utility Model Laid-Open Hei 4-57518(1992-57518,U,JP) discloses a structure which uses parallel inclined plates. Japanese Patent Laid-Open Hei 4-136311(1992-136311,A,JP) discloses a structure wherein a submerged breakwater is constructed at the offshore side of the main breakwater generating structure. In addition, as shown in FIG. 11, Japanese Patent Laid-Open Hei 10-2565 (1998-2565,A,JP) discloses a structure using composite wave breaking.

However, in the above submerged breakwaters or artificial reef, the structures therefore tend to be inevitably huge, because of the breakwater principle in which the breakwater effect is dependent on the shallowness of the breakwater generating structures and the width (a wave propagation direction).

For example, in the above breakwater generating structures utilizing composite breaking waves, special composite breaking waves are generated with the double reef structure comprising an upper reef and a lower reef of which the length is designed to be 6.5 times longer than that of the depth of the water.

In order to obtain sufficient breakwater effect, the structure must be huge enough, thereby the construction cost is high and the construction period becomes long.

An objective of the present invention is to provide a breakwater generating structure, such as a submerged breakwater generating structure by utilizing the composite wave breaking, which is comparatively small and is constructed at a lower cost.

In addition, when the breakwater prevents the waves effectively from reaching the coast, a coastal area behind the submerged breakwater generating structure becomes calm, thereby gathering fish and other creatures behind the breakwater (swarming effect). However, when sea water stands still at a bottom layer, sludge may be deposited and the sea water exchange inside the breakwater takes a long time, and meanwhile, bacteria may consume a large amount of dissolved oxygen in the sea water to decompose organic materials in the sludge and the dissolved oxygen becomes low, thereby resulting in a bad influence to lives such as those of fish and shellfish.

Thus, the invention also enables efficient exchange of seawater behind the breakwater for supplying sufficient dissolved oxygen in the seawater for the lives.

SUMMARY OF THE INVENTION

The breakwater generating structure of the present invention is constructed compactly by providing a vertical wall at the offshore side of the reef, forming the openings at the bottom end of the vertical wall, and further providing slits protruding inside the reef on a top of the structure.

The slanted slits are constructed by slit plates and the slit plates are inclined toward the direction along which the waves propagate, thereby capturing the breaking waves in the reef.

Breaking waves rushing into the reef of a breakwater generating structure of a two-stage reef structure comprising a reef constructed on a mound are guided to the coast side. By providing the through paths at the coastal side of the reef which forms the upper reef, the sea water containing air brought by the breaking waves is sent to the water area at the coastal side to solve the lean oxygen state caused by stagnation of the seawater in the bottom layer behind the breakwater.

Wave amplitude is amplified by a slope of the sea bottom or the lower reef such as a mount as approaching the breakwater generating structure, and then greater breaking waves than usual are generated by the sudden decrease of the water depth at the vertical wall portion of the reef. Furthermore, because these breaking waves rushing into the slit decrease a conveyance rate of waves toward the coast, a calm sea area is created at the coastal side thereof.

The breaking waves rushing into the reef create a return water flow toward the offshore side through the opening of the vertical wall and sand brought into the reef is discharged by and together with the return water flow so as to prevent accumulation of the sand in the reef. Furthermore, the return water flow helps to generate breaking waves at the vertical wall portion while shifting the point of the breaking wave. The breaking waves can easily rush into the slits so that a wave energy may be lowered and a breakwater generating effect may be enhanced.

In addition, by providing a close portion defined by the upper portion continuous to the vertical wall together with the vertical wall, generation of breaking waves may be promoted by the return water flow on an upper surface of the closed portion toward the offshore side, at the same time, the breaking wave point is shifted so that the breaking waves may accurately rush into the slits.

The embodiment, in which the reef with the opening and the slit is placed on a mound, a lower reef, shown in FIG. 1 to form a breakwater generating structure 1, is described herein below.

A water depth where the breakwater generating structure 1 is placed is $h_1$, the total length of a mound 3 on which a reef 2 is placed is L, and the height of said mound 3 is $R_1$. The reef 2 having the length $X_2$, the vertical wall with the height $R_2$, and the opening with the height $R_2$ is placed on said mound so that the vertical wall 10 is positioned at distance $X_1$ from the offshore end of the mound. The depth from the water surface to the top of the structure is $R_3$.

On the upper portion of the reef 2, the slant slits 14 are disposed in spaced-apart relationship to each other and inclined to the angle (è) where the braking waves rush into the water surface with respect to the direction of the wave propagation.

Preferably, the depth of the top of the reef $R_3$ is not more than 1.5 m from the water level in a viewpoint of a breakwater generating effect, however, the depth should be selected by considering an effect to cruising ships. The depth of the top of the reef from the water level may be about 0.5 m when taking a measure in which buoys on the sea around the breakwater generating structure are placed.

On the mound 3 of the reef 2 at the coastal side, the ripraps or concrete blocks are laid for a coast side lower reef length $X_3$ to prevent the reef 2 from being moved by waves.

Waves of height $H_0$ approaches the breakwater generating structure, the wave height is amplified as the depth becomes shallower at the mound of the lower reef, and when the waves reach the vertical wall 10 of the reef 2, the breaking wave is generated because of sudden decrease of the depth. The breaking waves rush into the upper face of the reef 2 and pass through the slits 14, the wave energy is consumed and return water flow toward the opening 11 is generated so that sands brought into the reef may be discharged from the opening 11 together with the return water flow. Thus the sands do not accumulate in the reef and the space inside the reef is always maintained.

Creation of the return water flow from the opening 11 to the offshore shifts the wave breaking point of the generated breaking waves toward the offshore and also helps the breaking waves to rush into the slit 14 to lower the wave energy effectively.

The vertical blocks or ripraps on the coastal side of the reef 2 dissipate waves that are not captured by the slit 14 and also lower the energy converted from the waves to the flow at the upper portion of the reef. Then the waves that have passed through the breakwater generating structure are attenuated to the wave height $H_1$.

As a result of an experiment, to create the calm sea area by decreasing the ratio between the wave height $H_1$ and $H_0$ to not more than 0.3, it was found that the following relationships of parameters for the breakwater generating structure were required:

Lower reef height: $R_1=h_1/3$ to $h_1/2$

Vertical wall height: $R_2=h_1/3$ to $h_1/2$

Opening height: $R_4=R_2/10$ to $R_2/3$

Lower reef length: $X_1/1h_1$ to $3h_1$

Reef length: $X_2=2h_1$ to $4h_1$

Coastal side lower reef length: $X_3=1h_1$ to $3h_1$

Slit panel angle: $\theta=25$ to $45°$

DETAILED DESCRIPTION OF THE PREFERRED EMBODIMENTS

Reference will now be made in detail to the preferred embodiments of the present invention, examples of which are illustrated in the accompanying drawings.

Embodiments

Figure 1:
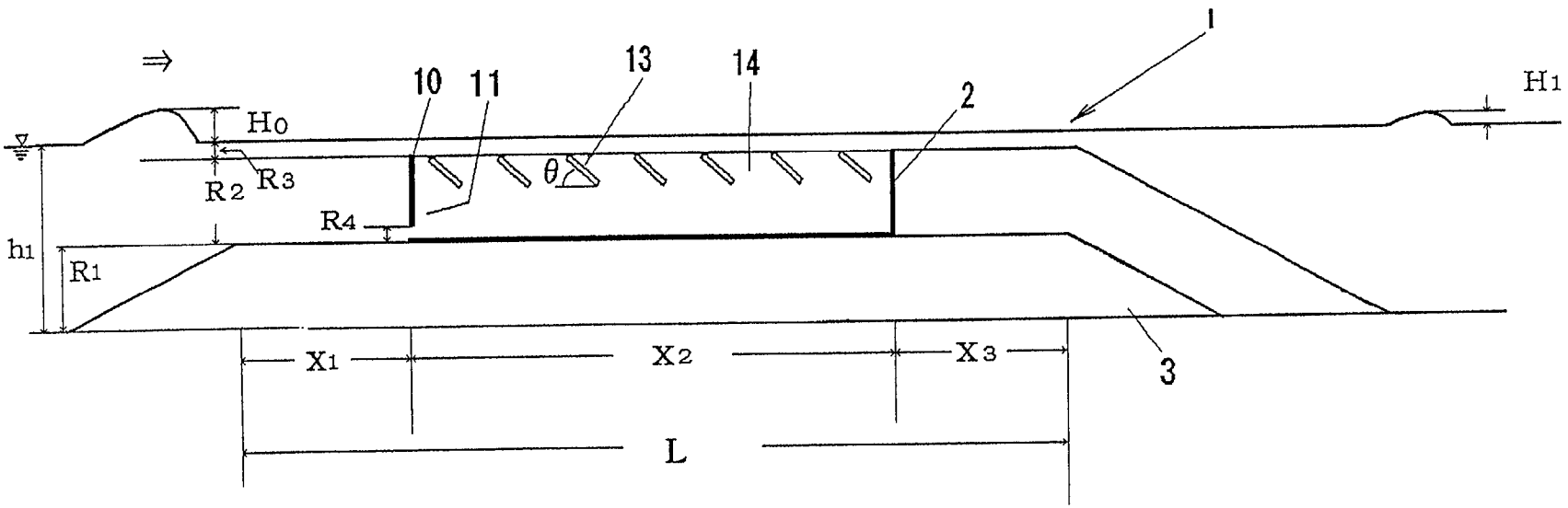
FIG. 1 is a cross sectional view of a breakwater generating structure.
Figure 2:
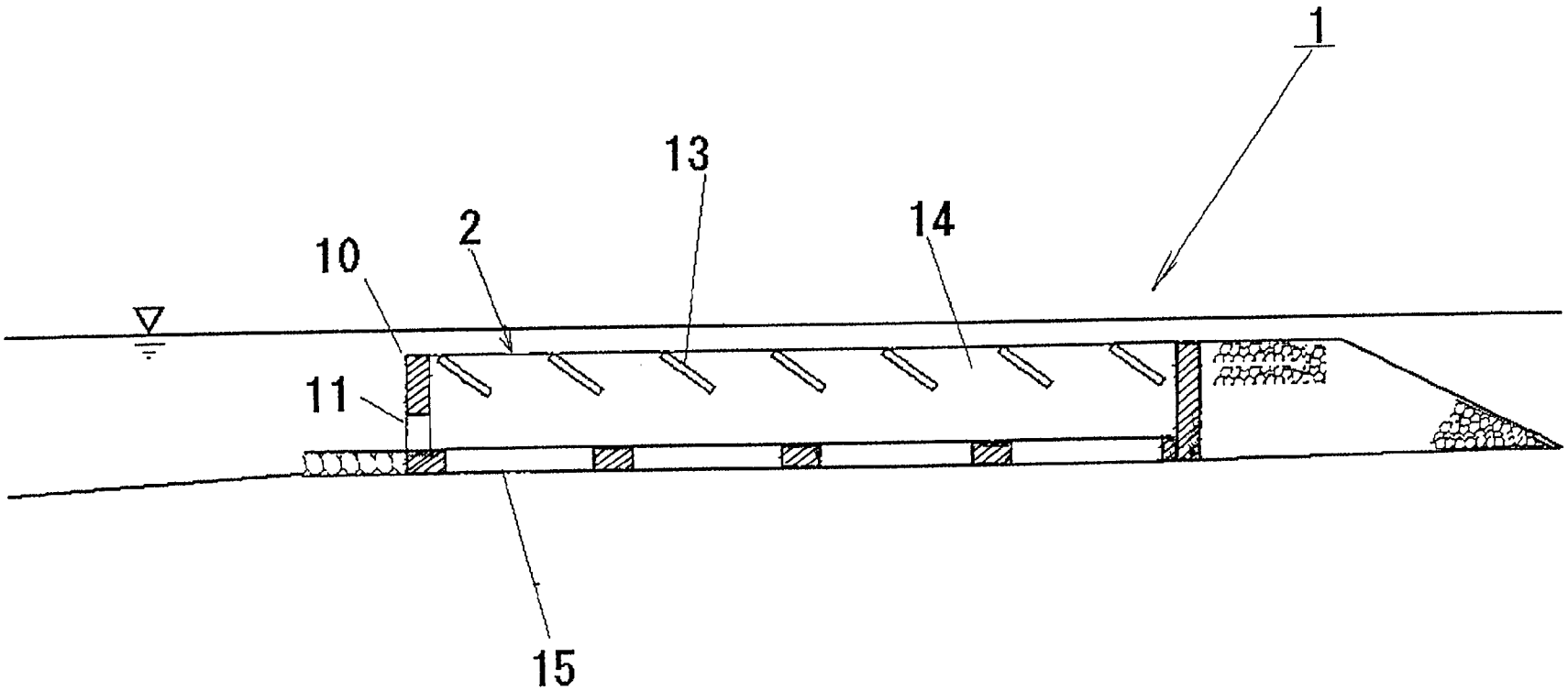
FIG. 2 is a cross sectional view of a breakwater generating structure.
Figure 3:
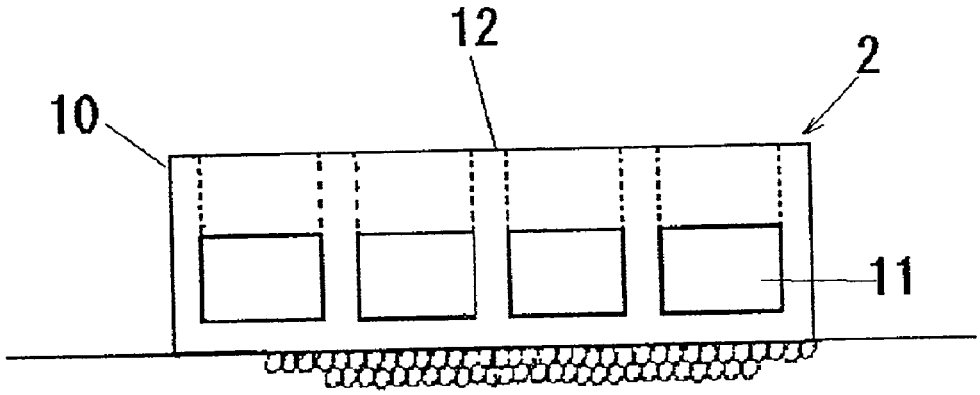
FIG. 3 is a front view of a breakwater generating structure.

As shown in FIGS. 2 and 3, a reef 2 of the breakwater generating structure 1 consists of a pre-stressed concrete box structure with a width of 10 m, a height of 3 m and a length of 20 m. An upper portion of the box is opened. An end of the reef 2 facing the offshore is a vertical wall with an opening 11 through the lower end of the vertical wall at the height of 1 m. The inner space of the reef 2 is partitioned by partition walls 12. On the upper portion of the reef 2, slit plates 13 are placed in a spaced-apart relationship to each other between the partition walls 12 and the slit plates 13 are inclined with respect to the direction along which waves propagate to form the slant slits 14. The reef 2 comprises one unit, and the units are placed along with the coast line for the required number of units.

The reef 2 is placed on the slope of the sea bottom aslant gradually from the coast so that the top of the reef becomes to be 1.5 m from the water surface. The ripraps are laid at the coastal side of the reef 2 to prevent the reef 2 from being moved by waves.

Waves propagating from the offshore are amplified as the water depth decrease, and when the waves reach the vertical wall 10 of the reef 2, breaking waves are created by the sudden decrease of the water depth. The breaking waves rush over the reef 2 and pass through the slant slits 14 so that the energy thereof may be decreased inside the reef and the return water flow toward the opening 11 is generated. The sand brought into the reef may be discharged from the opening 11 together with the return water flow so that the sand does not accumulate and the space inside the reef may be always maintained.

The ripraps at the coastal side of the reef 2 dissipate the waves that cannot be captured by the slits 14 together with dissipating the energy converted to flow from the waves at the upper portion of the reef. Because generation of the water flow from the coast to the offshore is suppressed, a movement of the sand at the sea bottom becomes small so that erosion of the beach may be prevented. In addition, a plurality of square holes 15 are formed through the bottom of the reef 2 so that no great uplift force affects a bottom face of the reef 2.

Figure 4:
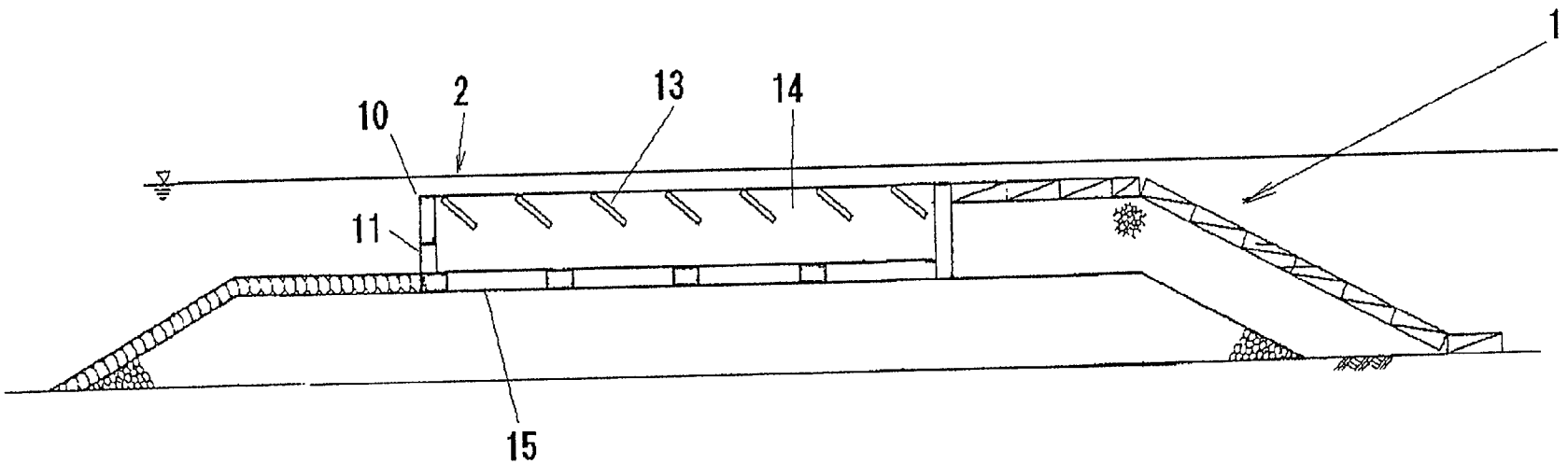
FIG. 4 is a sectional view of a breakwater generating structure having a double reef structure.

The embodiment in FIG. 4 shows the breakwater generating structure 1 formed by constructing a riprap mound 3 having a height of 3 m, length of 40 m, and slope of 1:2 on the sea bottom and placing the reef 2 made of pre-stressed concrete having a width of 10 m, height of 3 m, and length of 15 m on the mound 3 at 10 m away from the offshore end thereof.

The upper portion of the reef 2 is opened and the opening 11 having a height of 40 cm is made on the lower end of the vertical wall 10. The inner space of the reef is partitioned by the partition walls 12. In the upper opening of the reef 2, the slit plates 13 are slanted 30 degrees against the direction along which the waves propagate and disposed at a spaced-apart relationship to each other between the partition walls 12 to form the slits 14. A plurality of the square holes 15 are formed on the bottom of the reef 2.

The ripraps are laid at the coastal side of the breakwater generating structure 1 and concrete blocks are laid on the surface thereof so that the roughness becomes high, thereby absorbing energy of the waves that are not captured by the slits 14.

The concrete blocks are laid on the surface of the mound 3, for preventing scouring by a downforce element of the return water flow toward the offshore through the opening 11. Preferably, the above concrete blocks are laid for ½ of the lower reef length $X_1$ or more.

Waves rushing into the breakwater generating structure 1 are amplified by the mound 3 rising from the sea bottom, then the breaking waves are generated by sudden decrease of the water depth at the vertical wall 10. Thereafter the generated breaking waves rush into the slits 14, and their energy is dissipated within the reef and the return water flow toward the opening 11 is also generated.

The return water flow toward the offshore through the opening 11 also promotes the generation of the breaking waves, and at the same time, the breaking wave point is generated on the slit so that the breaking waves may accurately rush into the slits.

Figure 5:
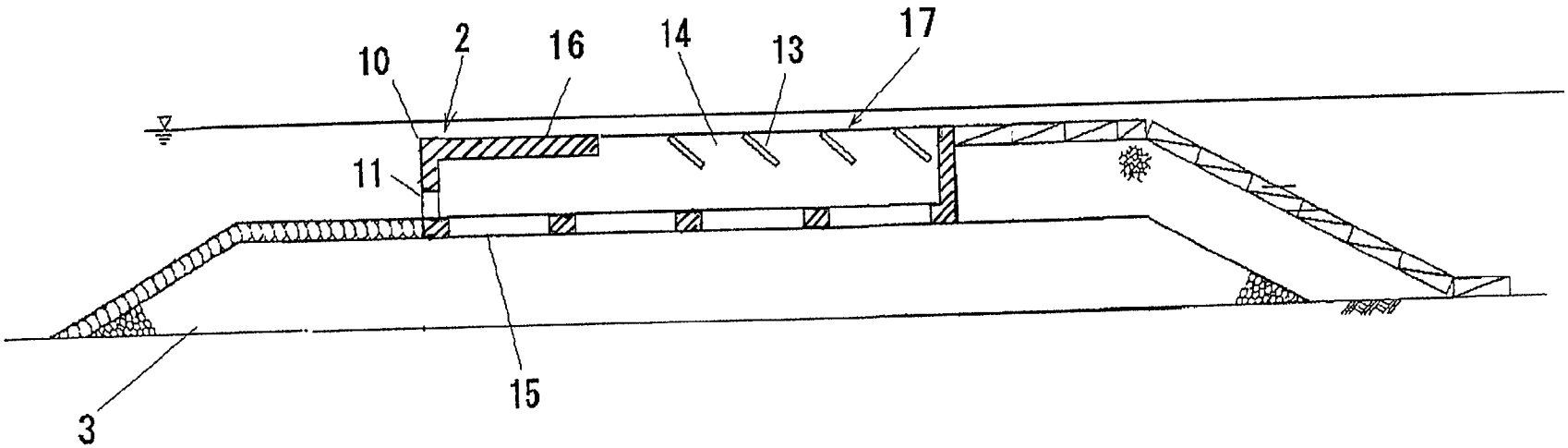
FIG. 5 is a cross sectional view of a breakwater generating structure placed on a support structure.

The embodiment shown in FIG. 5 is essentially the same as the embodiment shown in FIG. 4, however, the portion of 5 m at the offshore side of the upper portion of the reef 2 is constructed as a closed portion 16 and the remaining portion of 10 m is constructed as an opened portion 17. On the upper opened portion of the upper surface of the reef 2, the slit plates 13 are slanted 30 degrees with respect to the direction along which the waves propagate and placed in a spaced-apart relationship to each other between the partition panels to form the slant slits 14.

Waves rushing into the breakwater generating structure are amplified by the mount 3 rising from the sea bottom, the breaking waves are generated by sudden decrease of the water depth at the vertical wall 10 at the upper closed portion 16. By rushing into the slits 14, the energy of the breaking water is lowered and the return water flow toward the opening 11 is generated at the same time.

The return water flow toward the offshore through the opening 11 and the return water flow toward the offshore from the closed portion 16 on the upper portion of the reef cooperatively promote the generation of the breaking waves, and at the same time, the breaking wave point is generated on the slits so that the breaking waves may accurately rush into the slits.

Preferably, the closed portion 16 may be set to be one-third (⅓) to one-half (½) of the length $X_2$ of the reef 2.

Figure 6:
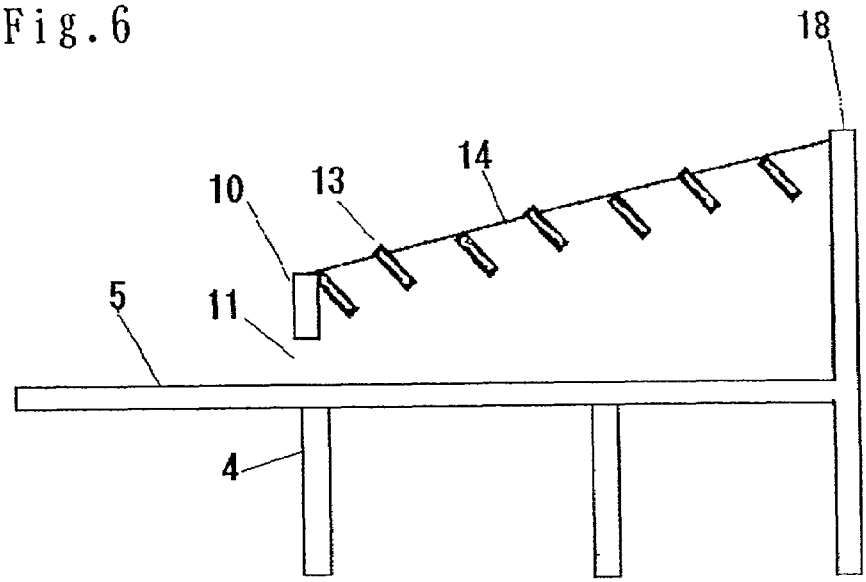
FIG. 6 is a cross sectional view of a breakwater generating structure with a closed portion placed on an upper surface of a reef.

In the embodiment shown in FIGS. 6 and 7, the reef 2 is constructed on a support 5 which is made by driving legs 4 such as concrete piles or steel pipes into the sea bottom, and its principle for breakwater generating is essentially the same as the breakwater generating structure described herein above. The support 5 corresponds to the mound and the incoming waves are amplified at the top of the support 5. The breaking waves are generated at the vertical wall 10 of the reef 2 so that the breaking waves may be caused to rush into the slits 14.

The height of a rear wall 18 constructed at the coastal side of the reef 2 is set to be higher than the height of the vertical wall 10 constructed at the offshore side, and the mounting positions of the slit plate 13 become increasingly higher toward the coast. Accordingly, the breaking waves are certainly captured by the slits 14 to prevent the waves from transferring to the coastal side over the rear wall 18.

In the legged breakwater generating structure described above, the rear wall 18 need not always be higher than the vertical wall and may have the same height as the height of the vertical wall. Basically, the mound is simply replaced by the support with legs.

The legs 4 are generally constructed with concrete piles, and the construction period may be reduced by manufacturing the support 5 as a steel structured jacket and the steel piles driven into the jacket to fix the jacket.

The breakwater generating structure with legs has an advantage that an influence to the environment may be minimized because the structure is constructed without filling the sea area and is effective when the water depth for the construction is deep or the slope of the sea bottom is steep. Alternatively, constructing a seated type breakwater generating structure on a soft and unstable sea bottom ground may cause sinking, the structure with legs described above, wherein the piles are driven into the foundation rock, is preferably adopted in order to prevent the sinking.

In addition, the present invention may be applied to an offshore breakwater as well as the breakwater generating structure.

Figure 8:
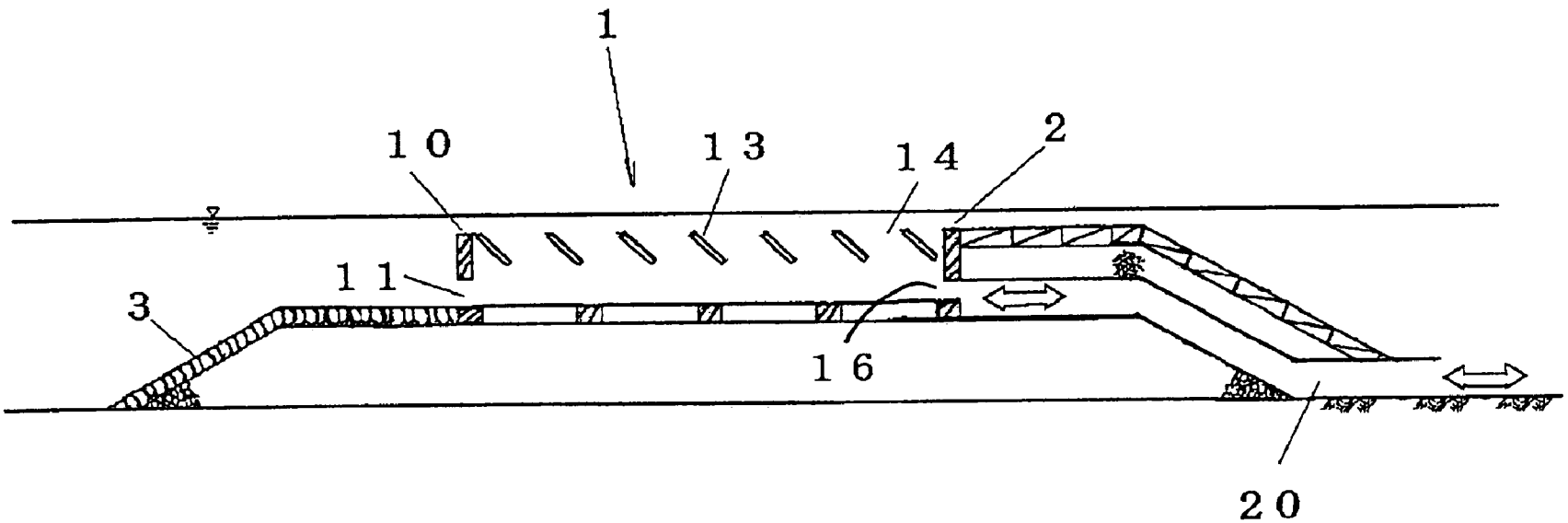
FIG. 8 is a sectional view of an embodiment of a breakwater generating structure.
Figure 9:
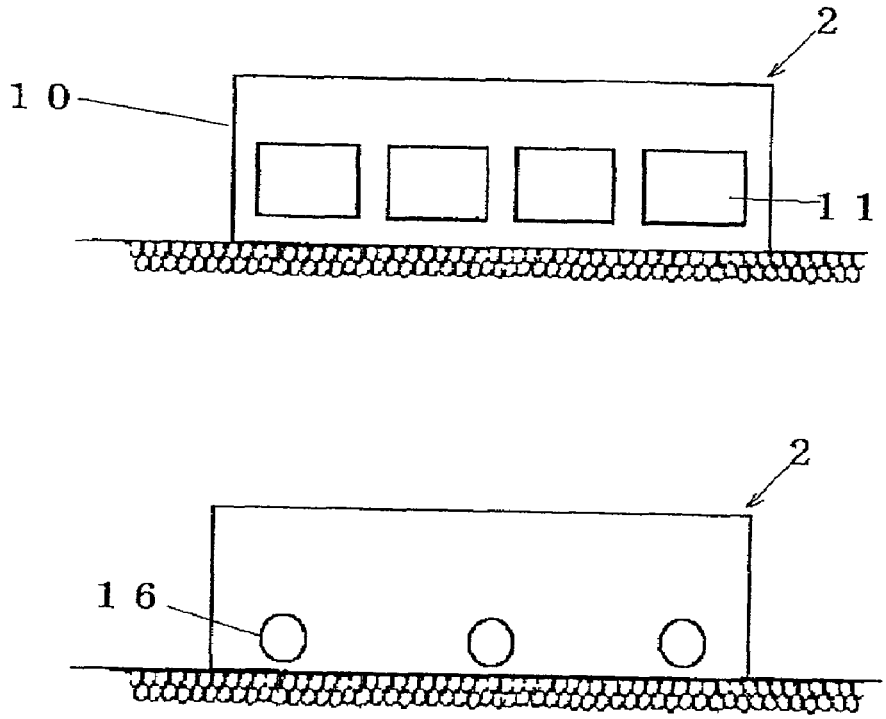
FIG. 9 is a front view from the offshore side and from the coastal side of a breakwater generating structure.

As shown in a sectional view of FIG. 8 and a front view of FIG. 9, the reef 2 is made of concrete and has the upper opening portion with a width of 10 m, height of 3 m, length of 20 m, and its offshore side end is constructed as the vertical wall 10 with the opening 11. The inner space of the reef 2 is partitioned by the walls. On the upper portion of the reef 2, the slit plate 13 is inclined 30 degrees with respect to the wave propagation direction, is spaced between the walls to form inclined slits 14. In the described embodiment, the reef 2 is constructed as one unit and a plurality of units are placed on the mound 3 along the seashore to form a desired length of the breakwater.

The reef 2 is placed such that the depth of the reef from the water level is set to be 0.5 m or more. At the coastal side of the reef 2, the ripraps are laid to prevent the reef from moving and blocks are laid at the front thereof. Through openings 16 are formed in the side wall of the reef 2 at the coastal side with spacings as shown in FIG. 9. The spacings and sizes of the through openings 16 are determined with respect to the replacement time of the sea water of the coastal side water area.

A pipe 20 is connected to each of the openings 16 to form a path where the sea water flows, and mouths are disposed at the ends of the pipes 20 to widen the diameter of the pipe to reduce the velocity of the sea water so that the sea bottom at the coastal side may not be disturbed.

Waves from the offshore become the breaking waves, then rush into the upper portion of the reef 2. The breaking waves pass through the slant slits 14 and then their energy is lowered inside the reef 2. The breaking waves that have been converted to the water flow are guided to the rear portion of the breakwater from the through opening 16 formed through the side wall at the coastal side to the through paths 19. Because the breaking waves include air flow through the through paths 19, the sea water contains sufficient dissolved oxygen.

Also, the breaking waves create in the reef the return water flow toward the opening 11 of the reef 2 and discharge the sand brought into the reef 2 to the outside from the opening 11.

The ripraps at the coastal side of the reef 2 dissipate the waves that are not captured by the slanted slits 14 together with lowering the energy of the flow converted from the waves on the upper portion of the reef.

Figure 10:
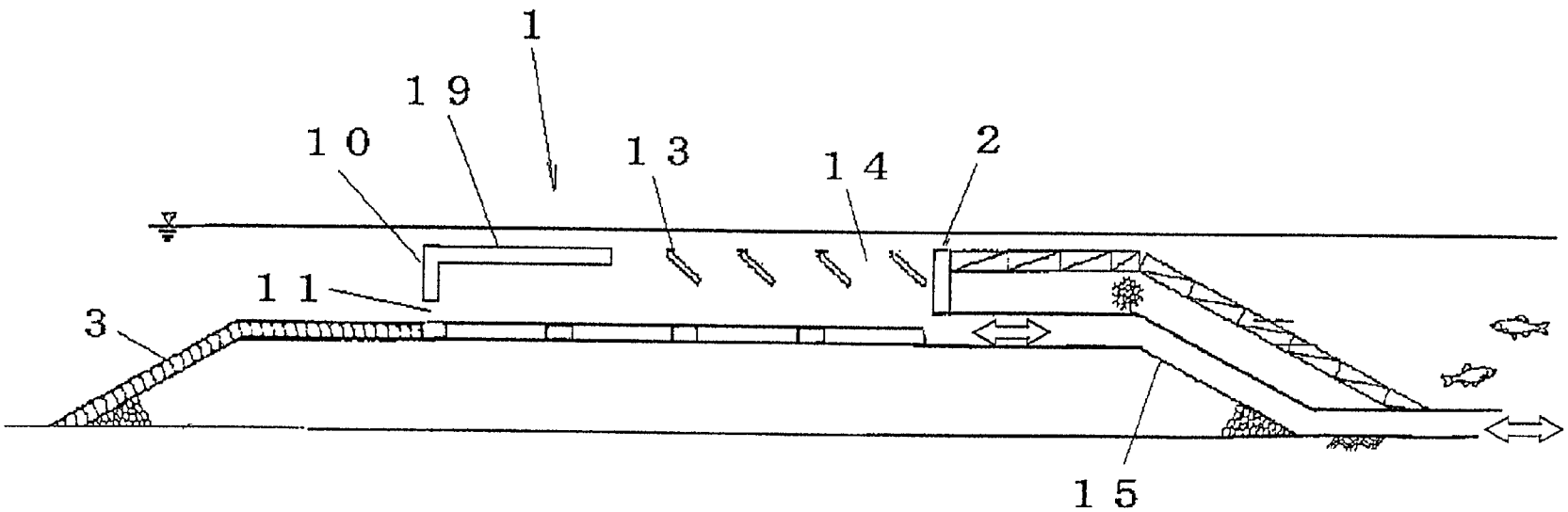
FIG. 10 is a front sectional view of another embodiment of the breakwater generating structure.
Figure 11:
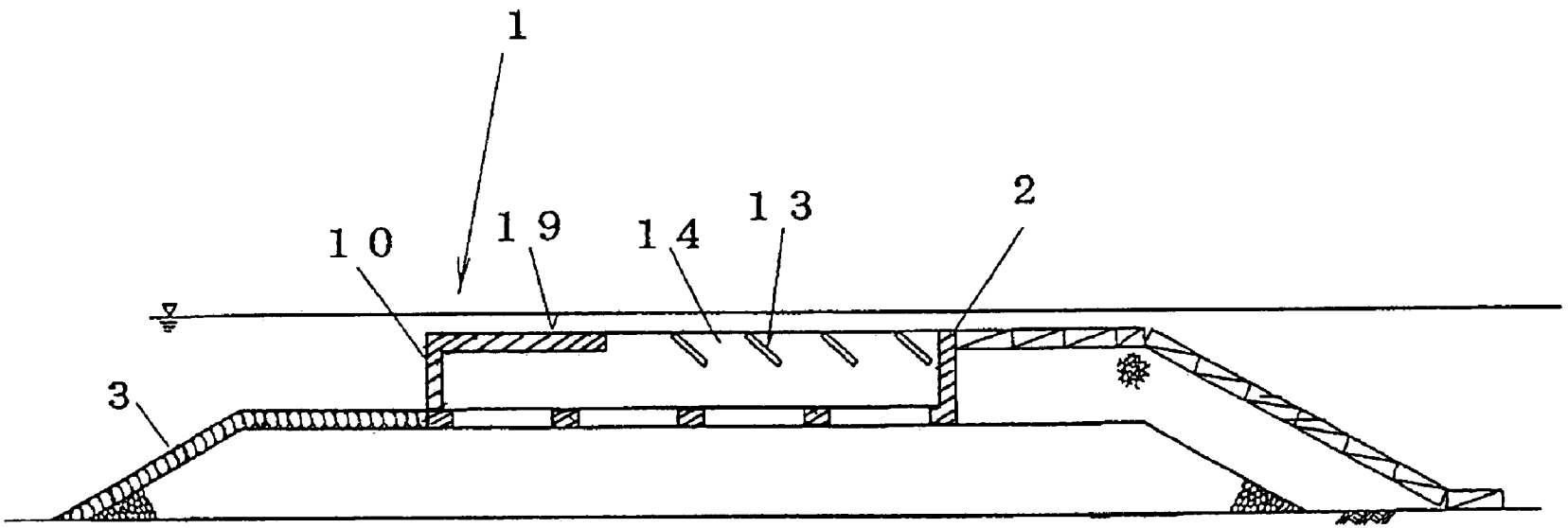
FIG. 11(PRIOR ART)
FIG. 11 is a sectional view of the conventional breakwater generating structure.

The embodiment depicted in FIG. 10 shows the breakwater generating structure 1 which is constructed by providing the riprap mound 3 having a height of 3 m, a total length of 40 m, and a slope of 1:2 on the sea bottom and placing the reef 2 made of concrete having a width 10 m, height of 3 m, and length of 15 m at 10 m from the offshore side end of the mound 3.

Figure 7:
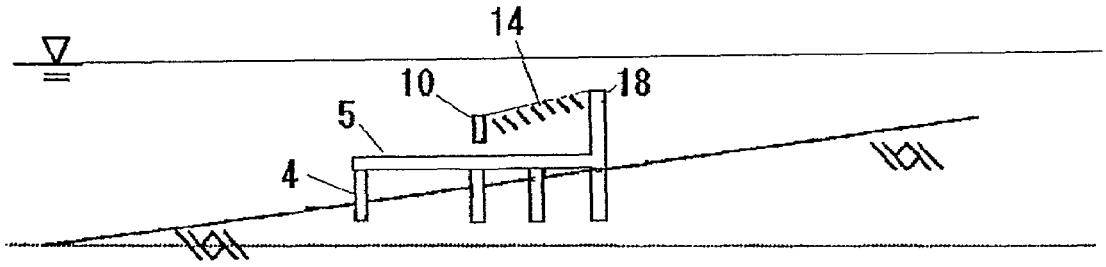
FIG. 7 is a front view of the breakwater generating structure with legs.

Although the breakwater generating structure is essentially the same as the embodiment described in FIG. 7, the portion of 5 m from the offshore side on the upper portion of the reef 2 is constructed as the closed portion 19 and the remaining portion of 10 m is left opened to provide the open portion 17. On the upper opened portion of the reef 2, the slit plates 13, slanted at 30 degrees with respect to the direction of the propagation of the waves, are positioned in spaced-apart relationship to each other to form the slanted slits 14.

In addition, a plurality of square holes are formed on the bottom of the reef 2 to make the surface to which the uplift force affects small for preventing the reef 2 from floating.

The ripraps are laid at the coastal side of the breakwater generating structure 1 and the foot protection blocks are placed on the surface thereof to dissipate the waves that are not captured by the slits 14 together with making the roughness against the water flow high.

The concrete blocks are laid at the front surface of the mound 3 for preventing scouring by the downforce element of the return water flow toward the offshore through the opening 11. Preferably, the concrete blocks in the described embodiment may be laid for one-half (½) of the lower reef length or more.

The breakwater generating structure according to the present invention may provide a breakwater generating efficiency equal to or more, while providing smaller size, than the size of conventional breakwater generating structures by disposing the slits behind the vertical wall and guiding the breaking waves generated by the vertical wall to the slits.

Accordingly, the breakwater generating structure may be constructed at a low cost while enabling the shoaling beach be recovered on the steeply slanted eroded beach, enhancing the stability of the beach and a purification ability of the sea water such that an abundant beach environment may be created.

Furthermore, because a water area with a high degree of calmness can be created between the breakwater generating structure and the beach, a region appropriate for marine leisure may be provided.

Also, the slit and the entire breakwater generating structure of the present invention function as a gathering-place for fish by increasing variations of creatures and the amount of the dissolved oxygen increased by supplying oxygen with the jet effect of the breaking waves, thereby providing a preferable condition for raising creatures and increase the variety of creatures.

Furthermore, when the breakwater generating structure in accordance with the present invention applies to a littoral nourishment and an artificial beach on a gentle gradient beach, fine sands may be supplied by the improved breakwater generating effect and particle diameters of the sands on the beach may be made small so that a comfortable beach may be created.

By forming the slits at the portion into which the strong jets of the compound breaking waves rush, creation of splashes and horizontal swirls are inhibited. The waves that have rushed into the slit create the return water flow toward the offshore through the opening in the vertical wall and shift the breaking wave point so that the breaking waves may easily be captured by the slits. Accordingly, because the wave energy is lowered and regeneration of the waves may be prevented, breakwater generating is effectively performed while enabling the almost equal breakwater generating effect even though said breakwater generating structure has a more compact size than the conventional breakwater generating structure which utilizes the breaking waves.

The double reef structure decreases the transmission factor along with generation of the compound type breaking waves as well as the decrease of the reflection factor. Accordingly, the breakwater generating structure in accordance with the present invention lowers the energy of waves at a high efficiency and realizes effective dissipation of the waves.

The breakwater generating structure in accordance with the present invention may guide the breaking waves bringing air into the reef, then sends the sea water containing sufficient oxygen into the rear of the breakwater through the through path from the rear thereof to the bottom of the reef to improve the lean oxygen state of the sea water in the bottom layer behind the breakwater.

Accordingly, the seawater behind the structure is frequently replaced to supply sufficient oxygen and the adverse influence to fish and shellfish swarmed in the sea area made calm by the submerged breakwater is eliminated.

The invention claimed is:

1. A submerged breakwater generating structure comprising a reef having slits provided at an upper portion thereof and a vertical wall defining said reef at an offshore side thereof, the vertical wall having at least one opening at a lower end thereof, said reef being formed as two stages and placed on a mound, a through path being provided from said reef to a coastal side of said breakwater generating structure and an opening end of said through path being provided to a base of said mound.

2. The breakwater generating structure according to claim 1, wherein said slits are inclined with respect to the direction along which waves propagate.

3. The breakwater generating structure according to claim 1, wherein said reef has a breaking wave generation section formed as a closed upper portion defined between said vertical wall and said slits.

4. A submerged breakwater generating structures comprising an open box having a vertical wall for producing a breakwater at an offshore side, said vertical wall having at least one opening at a lower end and slits inclined with respect to the direction along which waves propagate disposed at the top portion of said box, said slits defining openings provided in a spaced-apart relationship between said vertical wall and a second vertical wall of said open box.

5. The submerged breakwater generating structure according to claim 4, wherein said box has a breaking wave generation section formed as a closed upper portion between said vertical wall and said slits.

6. The submerged breakwater generating structure according to claim 4, wherein at least one hole is formed at the bottom of said box.

7. The submerged breakwater generating structure according to claim 4, wherein a height of a coastal side wall of said box is higher than a height of said vertical wall and positions of said slits are arranged to become higher toward said coast.

8. A submerged breakwater generating structure comprising an open box having a vertical wall for producing a breakwater at an offshore side, said vertical wall having at least one opening at a lower end thereof and slits inclined with respect to the direction along which waves propagate disposed at the top portion of said box, said slits defining openings provided in a spaced-apart relationship between said vertical wall and a second vertical wall of said open box, said box being formed as two stages and placed on a mound.

9. The submerged breakwater generating structure according to claim 8, wherein said box has a breaking wave generation section formed as a closed upper portion between said vertical wall and said slits.

10. The submerged breakwater generating structure according to claim 8, wherein a through path is provided from said box to a coastal side of said breakwater generating structure.

11. A submerged breakwater generating structure comprising an open box having a vertical wall for producing a breakwater at an offshore side, said vertical wall having at least one opening at a lower end thereof and inclined slits with respect to the direction along which waves propagate disposed at the top portion of said box, said box being formed as two stages and placed on a mound and a through path provided from said box to a coastal side of said breakwater generating structure, an opening end of said through path being provided to a base of said mound.

12. A submerged breakwater generating structure comprising an open box having a vertical wall for producing a breakwater at an offshore side, said vertical wall having at least one opening at a lower end thereof and inclined slits with respect to the direction along which waves propagate disposed at the top portion of said box, and a support comprising a leg structure on which the open box is placed.

13. In a method of attenuating waves with a submerged breakwater generating structure, the improvement comprising bringing the waves into contact with a submerged breakwater generating structure comprising a reef having slits provided at an upper portion thereof and a vertical wall defining said reef at an offshore side thereof, the vertical wall having at least one opening at a lower end thereof, said reef being formed as two stages and placed on a mound, a through path being provided from said reef to a coastal side of said breakwater generating structure and an opening end of said through path being provided to a base of said mound.

14. In a method of attenuating waves with a submerged breakwater generating structure, the improvement comprising bringing the waves into contact with a submerged breakwater generating structure comprising an open box having a vertical wall for producing a breakwater at an offshore side, said vertical wall having at least one opening at a lower end and slits inclined with respect to the direction along which waves propagate disposed at the top portion of the box, said slits defining openings provided in a spaced-apart relationship between said vertical wall and a second vertical wall of said open box.

15. In a method of attenuating waves with a submerged breakwater generating structure, the improvement comprising bringing the waves into contact with a submerged breakwater generating structure comprising an open box having a vertical wall for producing a breakwater at an offshore side, said vertical wall having at least one opening at a lower end thereof and slits inclined with respect to the direction along which waves propagate disposed at the top portion of said box, said slits defining openings provided in a spaced-apart relationship between said vertical wall and a second vertical wall of said open box, said box being formed as two stages and placed on a mound.

* * * * *

UNITED STATES PATENT AND TRADEMARK OFFICE

CERTIFICATE OF CORRECTION

PATENT NO. : 7,404,692 B2
APPLICATION NO. : 09/863749
DATED : July 29, 2008
INVENTOR(S) : Tadashi Fukumoto et al.

It is certified that error appears in the above-identified patent and that said Letters Patent is hereby corrected as shown below:

On the title page, item [30], please insert:

--Foreign Application Priority Data

May 26, 2000 (JP) 2000-156893

February 19, 2001 (JP) 2001-42294--

Signed and Sealed this

Eighteenth Day of November, 2008

JON W. DUDAS
*Director of the United States Patent and Trademark Office*